US011781810B2

(12) United States Patent
Inoue

(10) Patent No.: US 11,781,810 B2
(45) Date of Patent: Oct. 10, 2023

(54) DRYING DEVICE

(71) Applicant: PHOENIX ELECTRIC CO., LTD., Hyogo (JP)

(72) Inventor: Tomohiko Inoue, Hyogo (JP)

(73) Assignee: PHOENIX ELECTRIC CO., LTD., Hyogo (JP)

( * ) Notice: Subject to any disclaimer, the term of this patent is extended or adjusted under 35 U.S.C. 154(b) by 276 days.

(21) Appl. No.: 17/167,425

(22) Filed: Feb. 4, 2021

(65) Prior Publication Data

US 2021/0262728 A1 Aug. 26, 2021

(30) Foreign Application Priority Data

Feb. 26, 2020 (JP) ..... 2020-030813
Jan. 8, 2021 (JP) ..... 2021-001877

(51) Int. Cl.
*F26B 3/20* (2006.01)
*F26B 3/28* (2006.01)

(52) U.S. Cl.
CPC ..... *F26B 3/283* (2013.01)

(58) Field of Classification Search
CPC ..... F26B 3/283; F26B 3/20; F26B 3/28; B41J 11/002
USPC ..... 34/611, 275
See application file for complete search history.

(56) References Cited

U.S. PATENT DOCUMENTS 10,247,475 B2 * 4/2019 Valia ..... A45D 29/00
2006/0204670 A1 * 9/2006 Siegel ..... B41J 11/00214 427/532
2007/0103875 A1 * 5/2007 Reis ..... H04N 23/56 348/E5.029
2014/0338216 A1 * 11/2014 Li ..... A45D 29/00 34/275
2017/0080700 A1 3/2017 Landa et al.
2020/0171537 A1 * 6/2020 Hsieh ..... F26B 9/003

FOREIGN PATENT DOCUMENTS

CN 102029779 A 4/2011
CN 102729648 A 10/2012
CN 206317551 U 7/2017
CN 107667013 A 2/2018
CN 207579334 U 7/2018
JP 2006-007029 A 1/2006
JP 2006007029 A 1/2006

OTHER PUBLICATIONS

Notice of First Office Action of corresponding Chinese patent application No. 202110148933.5, dated Jun. 13, 2023, with English translation, 12 pages.
Outline of First Office Action of corresponding Chinese patent application No. 202110148933.5, dated Jun. 13, 2023, machine English translation, 3 pages.

* cited by examiner

*Primary Examiner* — John P McCormack
(74) *Attorney, Agent, or Firm* — LUCAS & MERCANTI, LLP

(57) ABSTRACT

The drying device is composed of an LED lamp unit and a thermally dispersing member. The LED lamp unit emits rays of light onto a work that a dried object is applied to the surface thereof. The thermally dispersing member is disposed on a stage and supports the work from the opposite side of the LED lamp unit. The thermally dispersing member generates heat by absorbing the rays of light transmitting through the work.

5 Claims, 4 Drawing Sheets

DRYING DEVICE

CROSS REFERENCE OF RELATED APPLICATION

This application claims the priority of Japanese Patent Applications No. 2020-030813 filed on Feb. 26, 2020 and No. 2021-001877 filed on Jan. 8, 2021, which are incorporated by reference herein.

BACKGROUND OF THE INVENTION

Field of the Invention

The present invention relates to a drying device used for drying a dried object applied to the surface of a work made of, for instance, a transparent glass plate.

Background Art

A variety of devices such as an ink jet device have been conventionally used for performing a work for applying solvent-based ink to the surface of a transparent glass panel (i.e., work) used as a cover member for a smart phone or so forth so as to create some kind of design on the glass panel surface (e.g., Japan Laid-open Patent Application Publication No. 2006-7029).

After applying the ink by the ink jet device or so forth, it is required to perform a processing step of drying the ink. This processing step is performed with a hot plate, a drying blower, a drying furnace, or so forth.

However, such a conventional method of drying an ink has had a drawback that it takes too much time for drying the ink. Because of this, the following demand could not have been satisfied completely: drying out an ink before the ink drops in an undried state due to gravity, for instance, when the ink is applied to a curved surface.

Besides, the following drawback has been also pointed out in use of the drying blower: An ink is undesirably moved in an undried state by the pressure of air blown out of the dying blower, whereby the ink is unevenly applied to an applied surface.

The present invention has been produced in view of the drawbacks described above. It is an object of the present invention to provide a drying device capable of quickly drying a dried object applied to the surface of a work.

SUMMARY OF THE INVENTION

According to an aspect of the present invention, a drying device is provided that includes an LED lamp unit and a thermally dispersing member. The LED lamp unit emits rays of light onto a work that a dried object is applied to a surface thereof. The thermally dispersing member is disposed on a stage and supports the work from an opposite side of the LED lamp unit. The thermally dispersing member generates heat by absorbing the rays of light transmitting through the work.

Preferably, the thermally dispersing member makes surface contact with the work.

Preferably, the LED lamp unit is formed by a plurality of LED lamps. The plurality of LED lamps include at least one LED lamp emitting the rays of light at a first wavelength and at least one LED lamp emitting the rays of light at a second wavelength.

Preferably, the LED lamp unit is formed by a plurality of LED lamps. The plurality of LED lamps include at least one LED lamp emitting the rays of light at a first intensity and at least one LED lamp emitting the rays of light at a second intensity.

Preferably, the drying device further includes a separating member arranged and installed between the stage and the thermally dispersing member such that the thermally dispersing member is disposed in a position away from the stage.

In the drying device according to the present invention, part of rays of light emitted from the LED lamp unit is incident on the dried object applied to the surface of the work, whereby the dried object absorbs the partial rays of light and rises in temperature. Besides, remaining of the rays of light, which has not been incident on the dried object, transmits through the work and is then incident on and absorbed by the thermally dispersing member.

This results in that the thermally dispersing member, which has risen in temperature by absorbing the rays of light, heats the entirety of the work. Consequently, the dried object further rises in temperature, whereby the dried object can be dried in as short a time as possible.

BRIEF DESCRIPTION OF THE DRAWINGS

Referring now to the attached drawings which form a part of this original disclosure.

DETAILED DESCRIPTION OF EMBODIMENTS (Configuration of Drying Device 10)

A configuration of a drying device 10 according to the present invention will be hereinafter explained with reference to drawings. It should be noted that, when used in combination, the drying device 10 and an ink applying device such as the ink jet device described above are collectively referred to as a work design device.

Figure 1:
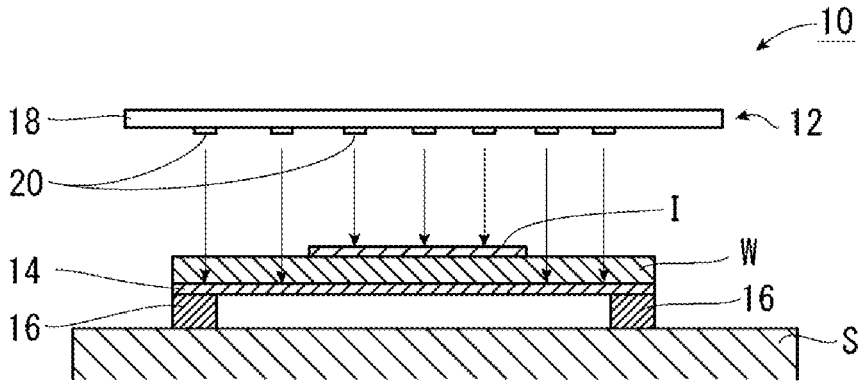
FIG. 1 is a diagram showing a configuration of a drying device 10 according to an exemplary embodiment to which the present invention is applied.

As shown in FIG. 1, the drying device 10 is mainly composed of an LED lamp unit 12, a thermally dispersing member 14, and a separating member 16.

The LED lamp unit 12 is a member for emitting rays of light onto a work W and includes a lamp unit body 18 and a plurality of LED lamps 20 mounted to the surface of the lamp unit body 18.

For example, the lamp unit body 18 is a general print circuit board that the plural LED lamps 20 are mounted to the surface thereof as COB (Chip On Board) lamps, SMD (Surface Mount Device) lamps, or so forth.

The plural LED lamps 20 are members for emitting rays of light at predetermined wavelengths. It is preferable to select the wavelengths of the rays of light depending on color, ingredient, or so forth of an ink I to be dried such that the rays of light can be absorbed most by the ink I.

Besides, the wavelengths of the rays of light emitted by the plural LED lamps 20 may be set to be equal to each other (i.e., the wavelengths of the rays of light emitted from the LED lamp unit 12 may be classified into a single type); alternatively, the wavelengths of the rays of light emitted by the plural LED lamps 20 may be set to be completely different from each other (i.e., the wavelengths of the rays of light emitted from the LED lamp unit 12 may be classified into a plurality of types equal in value to the number of the LED lamps 20). Furthermore, the LED lamp unit 12 may be configured to simultaneously include at least one LED lamp 20 emitting rays of light at a first wavelength and at least one LED lamp 20 emitting rays of light at a second wavelength (i.e., the wavelengths of the rays of light emitted from the LED lamp unit 12 may be classified into two or more types).

Thus, the single LED lamp unit 12 is configured to be capable of emitting rays of light at plural types of wavelengths, whereby the rays of light at the plural types of wavelengths can be simultaneously emitted; alternatively, by distinguishing from each other the rays of light depending on different types of wavelengths, rays of light at the same single type of wavelength can be emitted. Obviously, all the LED lamps 20 may be simultaneously lit up; alternatively, only part of the LED lamps 20 may be selectively lit up. For example, when the drying device 10 is used on a stand-alone basis, it can be assumed to light up the respective LED lamps 20 based on a pre-programmed lighting-up pattern. On the other hand, when the drying device 10 operates in conjunction with a printer (not shown in the drawings), for instance, it can be assumed to obtain color information of the ink I from the printer and selectively light up only part of the LED lamps 20 that emits rays of light at a suitable wavelength for the color of the ink I based on the color information.

Moreover, intensities of the rays of light emitted by the plural LED lamps 20 may be also set to be equal to each other (i.e., the intensities of the rays of light emitted from the LED lamp unit 12 may be classified into a single type); alternatively, the intensities of the rays of light emitted by the plural LED lamps 20 may be set to be completely different from each other (i.e., the intensities of the rays of light emitted from the LED lamp unit 12 may be classified into a plurality of types equal in value to the number of the LED lamps 20). In addition, the LED lamp unit 12 may be configured to simultaneously include at least one LED lamp 20 emitting rays of light at a first intensity and at least one LED lamp 20 emitting rays of light at a second intensity (i.e., the intensities of the rays of light emitted from the LED lamp unit 12 may be classified into two or more types).

Thus, the single LED lamp unit 12 is configured to be capable of emitting rays of light at plural types of intensities, whereby the rays of light at the plural types of intensities can be simultaneously emitted; alternatively, by distinguishing from each other the rays of light depending on different types of intensities, rays of light at the same single type of intensity can be emitted. Obviously, all the LED lamps 20 may be simultaneously lit up; alternatively, only part of the LED lamps 20 may be selectively lit up. For example, the following configuration can be assumed when the ink I is applied to the surface of the work W with curved surface and the LED lamps 20 are disposed at different distances to the work W: At least one LED lamp 20, disposed at a short distance to the work W, emits rays of light at a relatively low intensity, whereas another at least one LED lamp 20, disposed at a long distance to the work W, emits rays of light at a relatively high intensity.

The thermally dispersing member 14 is a member made of material that generates heat by absorbing the rays of light emitted from the LED lamp unit 12. Besides, the thermally dispersing member 14 is disposed on a stage S so as to support the work W by making contact with a surface of the work W that is on the opposite side of the surface thereof irradiated by the LED lamp unit 12. Incidentally, the following materials can be assumed as examples of the material of the thermally dispersing member 14: aluminum processed with black alumite treatment, graphite, silicon wafer, resin molded member in which carbon is kneaded, black ceramic ($Al_2O_3$+TiC), and black plating.

In the present exemplary embodiment, the surface of the work W, making contact with the thermally dispersing member 14, is made in the shape of a flat surface. Hence, the work W and the thermally dispersing member 14 make surface contact with each other. However, it can be also assumed that depending on the shape of the work W, the work W and the thermally dispersing member 14 make contact with each other at a plurality of points. As described below, from the perspective of efficiency in drying the ink I applied to the work W, it is preferable that the work W and the thermally dispersing member 14 make surface contact with each other.

The separating member 16 is a member disposed between the stage S and the thermally dispersing member 14. In the present exemplary embodiment, four separating members 16 are disposed on four corners of the thermally dispersing member 14. The separating members 16 serve to dispose the thermally dispersing member 14 in a position away from the stage S. By thus keeping the thermally dispersing member 14 away from the stage S, a space is formed between the thermally dispersing member 14 and the stage S as a thermally insulating layer, whereby when the thermally dispersing member 14 generates heat by absorbing the rays of light emitted from the LED lamp unit 12, it can be made difficult to transfer the heat from the thermally dispersing member 14 to the stage S.

Figure 2:
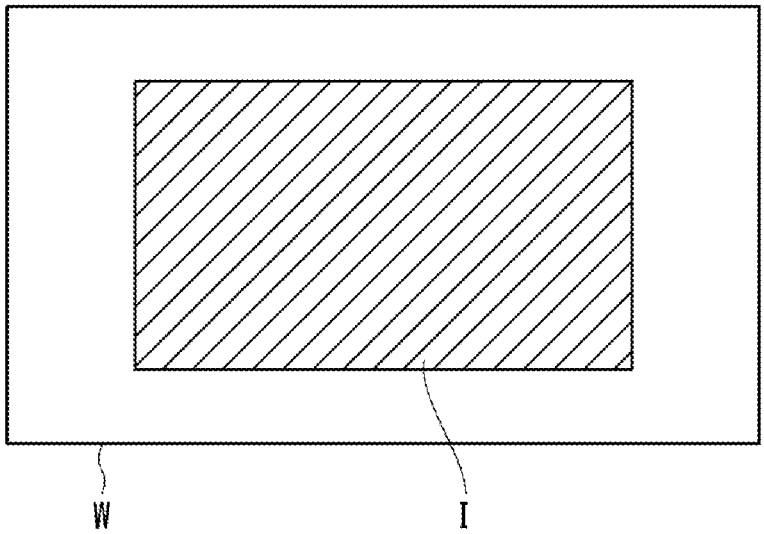
FIG. 2 is a diagram showing an exemplary configuration of applying an ink I to a work W.

Here, methods of applying the ink I to the work W will be exemplified. One exemplary method of applying the ink I can be assumed as follows: As shown in FIG. 2, the ink I is applied in a rectangular shape to a middle part of the surface of the work W, while remaining unapplied to the outer periphery of the middle part to which the ink I is applied.

Figure 3:
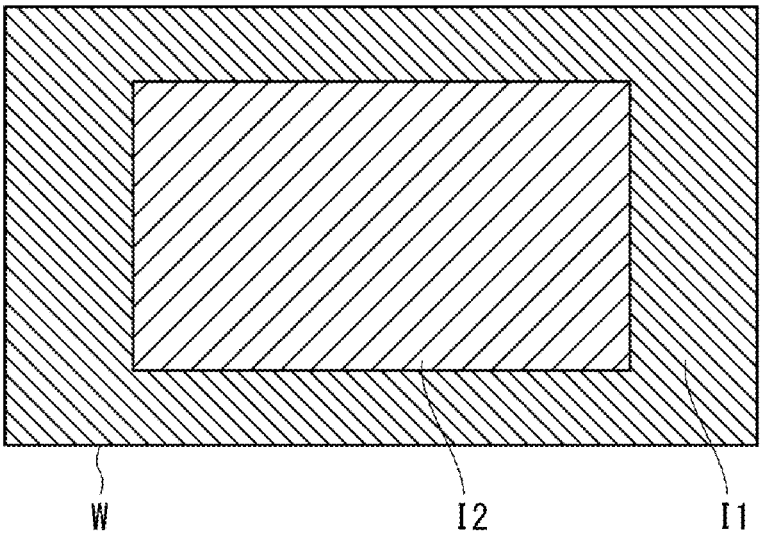
FIG. 3 is a diagram showing another exemplary configuration of applying the ink I to the work W.

Alternatively, another exemplary method can be assumed as follows: As shown in FIG. 3, an ink I1 is firstly applied to, and is then dried in, a peripheral edge part of the work W; thereafter, an ink I2 is applied to, and is then dried in, a middle part of the work W to which the ink I1 has not been applied yet.

(Features of Drying Device 10)

Figure 4:
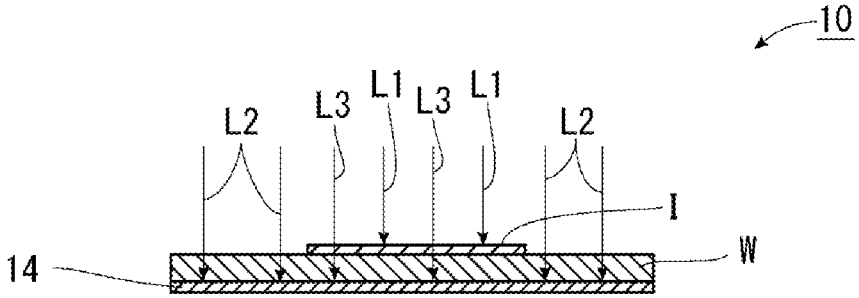
FIG. 4 is a diagram showing a path of rays of light absorbed by a heat dispersing member 14.

As shown in FIG. 4, in the drying device 10 according to the present exemplary embodiment, part (L1) of rays of light emitted from the LED lamp unit 12 is incident on the ink I applied to the surface of the work W, whereby the ink I absorbs the partial rays of light (L1) and rises in temperature. Besides, remaining (L2) of the rays of light, which has not been incident on the ink I, transmits through the work W and is then incident on and absorbed by the thermally dispersing member 14. Furthermore, there even exist another part (L3) of the rays of light, depending on light transmittance of the ink I per se and the film thickness of the ink I. The part (L3) of the rays of light is incident on the ink I, transmits therethrough, further transmits through the work W, and is absorbed by the thermally dispersing member 14.

This results in that the thermally dispersing member 14, which has risen in temperature by absorbing the rays of light, heats the entirety of the work W. Consequently, the ink I further rises in temperature, whereby the ink I can be dried in as short a time as possible.

Besides in the exemplary embodiment described above, the thermally insulating layer is formed between the thermally dispersing member 14 and the stage S by the separating members 16. Hence, when the thermally dispersing member 14 generates heat by absorbing the rays of light emitted from the LED lamp unit 12, it is made difficult to transfer the heat from the thermally dispersing member 14 to the stage S. Accordingly, the entirety of the work W can be raised in temperature as highly as possible by the heat from the thermally dispersing member 14. Hence, it is made possible to dry the ink I in a shorter time.

(Modification 1)

Figure 5:
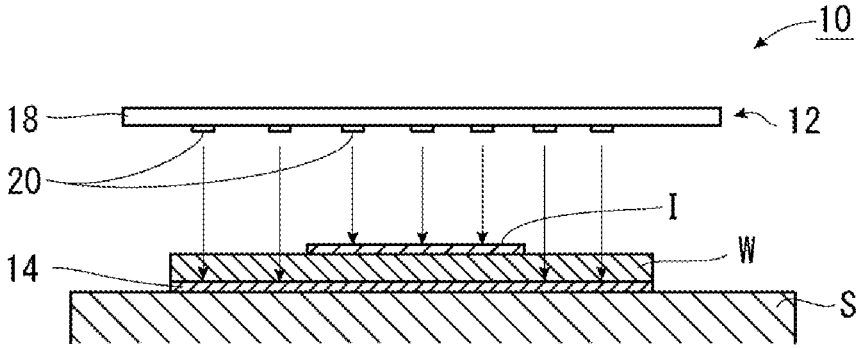
FIG. 5 is a diagram showing a configuration of the drying device 10 according to modification 1.

In the exemplary embodiment described above, the thermally insulating layer is configured to be formed between the thermally dispersing member 14 and the stage S with use of the separating members 16. However, as shown in FIG. 5, the thermally dispersing member 14 may make direct contact with the stage S by omitting the separating members 16.

It should be noted that when the thermally dispersing member 14 thus makes direct contact with the stage S, the amount of heat transferred to the stage S from the thermally dispersing member 14 inevitably increases, whereby the amount of heat for heating the work W inevitably reduces. Because of this, it is preferable to provide the separating members 16.

(Modification 2)

Alternatively, instead of the separating members 16, a thermally insulating member, made of a material with a relatively lower thermal conductivity than each of the stage S and the thermally dispersing member 14, may be interposed between the stage S and the thermally dispersing member 14.

(Modification 3)

Alternatively or additionally, the LED lamp unit 12 may be stationary with respect to the work W or may be configured to be moved with respect to the work W just like a printer head in emitting rays of light. Furthermore, both the stage S and the work W may be configured to be moved.

(Modification 4)

Alternatively or additionally, the thermally dispersing member 14 may not be a discrete member separated from the stage S but may be a part of the stage S. For example, the surface of the stage S (made of, e.g., aluminum (A5052) or stainless steel (SUS304)) may be processed with black alumite treatment or may be painted in black so as to be enhanced in light absorbing performance. The resultant processed or painted surface may be defined as the thermally dispersing member 14.

(Modification 5)

Figure 6:
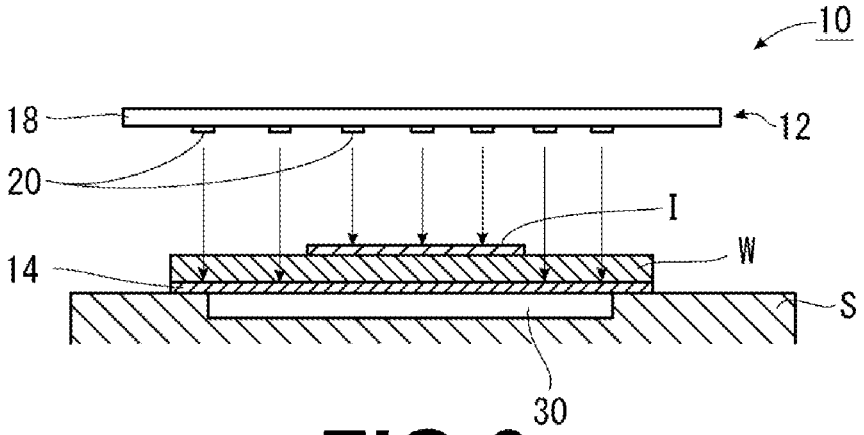
FIG. 6 is a diagram showing a configuration of the drying device 10 according to modification 5.

Alternatively, as shown in FIG. 6, the thermally dispersing member 14 may be mounted to the stage S, while making direct contact therewith by omitting the separating members 16. In this configuration, the stage S may be provided with a recess 30 on the surface thereof such that the recess 30 is in a corresponding position to the thermally dispersing member 14.

With the recess 30 herein provided, a space can be formed as a thermally insulating layer between the thermally dispersing member 14 and the surface (i.e., the bottom surface of the recess 30) of the stage S. Therefore, when the thermally dispersing member 14 generates heat by absorbing the rays of light emitted from the LED lamp unit 12, the thermally insulating layer makes it difficult to transfer the heat to the stage S. Accordingly, the entirety of the work W can be raised in temperature as highly as possible by the heat from the thermally dispersing member 14. Hence, it is made possible to dry the ink I in a shorter time.

Figure 7:
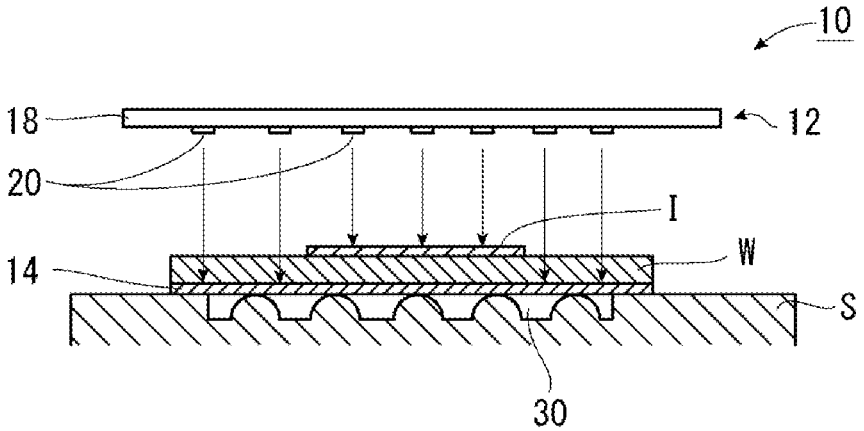
FIG. 7 is a diagram showing another configuration of the drying device 10 according to modification 5.

It should be noted that the recess 30 is not limited to be shaped in relatively large size as shown in FIG. 6. Instead, a plurality of recesses 30 with relatively small size may be provided as shown in FIG. 7.

(Modification 6)

Figure 8:
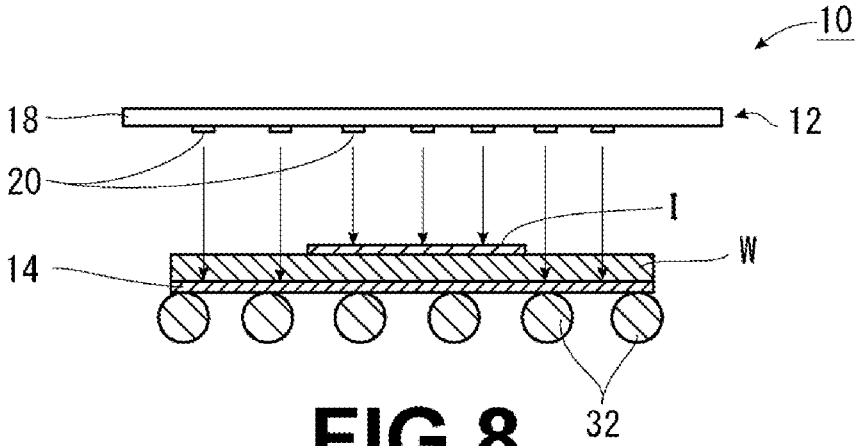
FIG. 8 is a diagram showing a configuration of the drying device 10 according to modification 6.

Alternatively, instead of the stage S made in the shape of a flat surface, a plurality of feeding rollers 32, each of which is made in substantially the shape of a column, may be aligned in parallel to each other as shown in FIG. 8. Then, the thermally dispersing member 14 may be mounted onto the feeding rollers 32.

With the configuration herein described, spaces are formed between adjacent feeding rollers 32. Hence, likewise the modification 5 and so forth, when the thermally dispersing member 14 generates heat by absorbing the rays of light emitted from the LED lamp unit 12, it is made difficult to transfer the heat to the feeding rollers 32 as the stage S. Accordingly, the entirety of the work W can be raised in temperature as highly as possible by the heat from the thermally dispersing member 14. Hence, it is made possible to dry the ink I in a shorter time.

(Modification 7)

Figure 9:
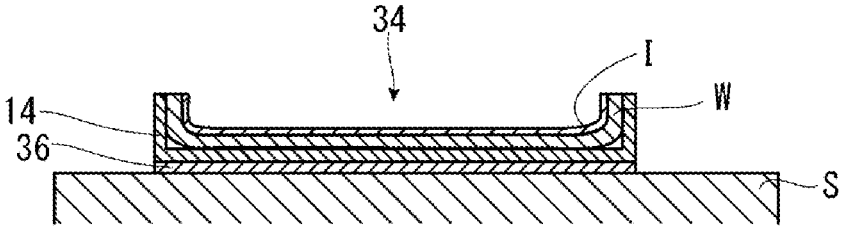
FIG. 9 is a diagram showing a configuration of the drying device 10 according to modification 7.

Alternatively, the thermally dispersing member 14 is not limited to be made in the shape of a flat plate as described above. For example, as shown in FIG. 9, the thermally dispersing member 14 may be provided with a recess 34 such that the cross-sectional shape thereof can be made in the shape of "square C".

The thermally dispersing member 14 is disposed on a thermally insulating member 36, which is made in the shape of a flat surface and is mounted to the surface of the stage S, such that the recess 34 faces upward.

Besides, the work W, upwardly curved at both ends thereof, is fitted to the recess 34, while the ink I is applied to the surface of the work W. In this condition, the LED lamp unit 12 is configured to emit rays of light onto the work W.

Figure 10:
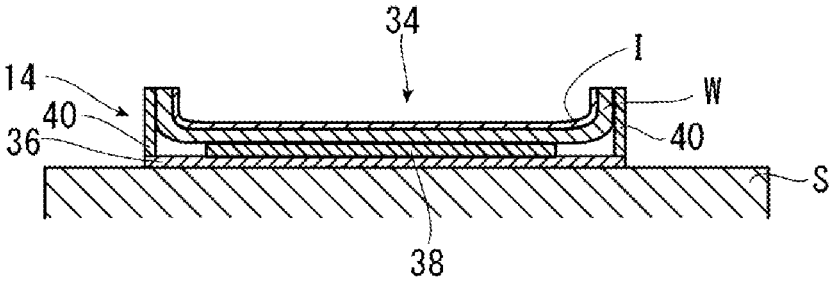
FIG. 10 is a diagram showing another configuration of the drying device 10 according to modification 7.

Obviously, the thermally dispersing member 14 provided with the recess 34 is not limited to the above. As shown in FIG. 10, the thermally dispersing member 14 provided with the recess 34 may be obtained by combining a bottom member 38 and a sidewall member 40.

(Modification 8)

In the examples described so far, the drying device 10 is used in an operation of drying the ink I applied to the surface of the work W (e.g., a frame member for a smart watch, a tablet or liquid crystal display, etc.). Applications of the drying device 10 are not limited to the above. For example, the drying device 10 can be also used in an operation of drying an infrared transmitting ink used for an infrared receiver of a smart phone, an operation of drying a functional material applied to a substrate, or an operation of drying functional polymer such as a coating agent. Such objects as described above (the ink I, the functional material, the functional polymer, etc.), for which the drying operation is performed with the drying device 10, will be collectively referred to as "dried object".

The following can be assumed as an example of the operation of "drying a functional material applied to a substrate": an operation of drying a photoresist on a semiconductor wafer such as a color filter on a glass substrate. For example, when a silicon wafer is employed as the work W, by appropriately selecting the wavelength of the rays of light emitted from the LED lamp unit 12, the silicon wafer per se absorbs the rays of light and contributes to heating the photoresist. By combining the thermally dispersing member 14 to this configuration, the drying operation can be achieved as efficiently as possible. Incidentally, prebake and postbake can be assumed as the processing steps of drying the photoresist. The prebake is a processing step of removing a solvent contained in the photoresist. The postbake is a processing step of baking and hardening the photoresist.

Furthermore, the drying device 10 can be also used for annealing of a thin film disposed on the semiconductor wafer. At this time, the thermally dispersing member 14 contributes to heat equalization of the work W. Besides, light output control by the LED lamp unit 12 can be used.

The following can be assumed as an example of the operation of "drying functional polymer such as a coating agent": an operation of drying a clear ink (overcoat agent), i.e., a protective coating on a painted surface and an unpainted surface of a smart phone cover or so forth. Even when transparent, the ink can be efficiently dried by the heat from the thermally dispersing member 14.

Although the invention has been described in its preferred form with a certain degree of particularity, it is understood that the present disclosure of the preferred form has been changed in the details of construction and the combination and arrangement of parts may be resorted to without departing from the spirit and scope of the invention as hereinafter claimed.

The disclosure of Japanese Patent Applications No. 2020-030813 filed on Feb. 26, 2020 and No. 2021-001877 filed on Jan. 8, 2021 including specification, drawings and claims are incorporated herein by reference in their entirety.

What is claimed is:

1. A drying device comprising:

an LED lamp unit emitting rays of light onto a work that an object to be dried is applied to a surface thereof; and a thermally dispersing member disposed on a stage, the thermally dispersing member supporting the work from an opposite side of the LED lamp unit, wherein the LED lamp unit and the thermally dispersing member are configured that the thermally dispersing member generates heat by absorbing the rays of light that emits from the LED lamp unit and transmits through the work.

2. The drying device according to claim 1, wherein the thermally dispersing member makes surface contact with the work.

3. The drying device according to claim 1, wherein the LED lamp unit is formed by a plurality of LED lamps, and the plurality of LED lamps include at least one LED lamp emitting the rays of light at a first wavelength and at least one LED lamp emitting the rays of light at a second wavelength.

4. The drying device according to claim 1, wherein the LED lamp unit is formed by a plurality of LED lamps, and the plurality of LED lamps include at least one LED lamp emitting the rays of light at a first intensity and at least one LED lamp emitting the rays of light at a second intensity.

5. The drying device according to claim 1, further comprising:

a separating member arranged and installed between the stage and the thermally dispersing member such that the thermally dispersing member is disposed in a position away from the stage.

* * * * *